US006178767B1

(12) United States Patent
Pravda

(10) Patent No.: US 6,178,767 B1
(45) Date of Patent: Jan. 30, 2001

(54) COMPACT ROTARY EVAPORATIVE COOLER

(76) Inventor: Milton F. Pravda, 7708 Greenview Ter., Towson, MD (US) 21204

( * ) Notice: Under 35 U.S.C. 154(b), the term of this patent shall be extended for 0 days.

(21) Appl. No.: 09/369,485

(22) Filed: Aug. 5, 1999

(51) Int. Cl.[7] ..... F28D 5/00
(52) U.S. Cl. ..... 62/310; 62/315
(58) Field of Search ..... 62/310, 315; 165/86

(56) References Cited

U.S. PATENT DOCUMENTS

| | | | | |
|---|---|---|---|---|
| 4,000,778 | * | 1/1977 | Laing | 165/86 |
| 4,020,898 | * | 5/1977 | Grover | 165/105 |
| 4,381,817 | * | 5/1983 | Brigida et al. | 165/110 |
| 4,405,013 | * | 9/1983 | Okamoto | 165/86 |
| 4,640,347 | * | 2/1987 | Grover et al. | 165/104.26 |
| 5,722,251 | * | 3/1998 | Nabiulin et al. | 62/309 |

* cited by examiner

*Primary Examiner*—William Doerrler
*Assistant Examiner*—Melvin Jones
(74) *Attorney, Agent, or Firm*—Olson and Olson

(57) ABSTRACT

The compact rotary evaporative cooler of this invention includes a case containing a powered rotor mounting a partition that divides the case longitudinally into a wetted chamber and a nonwetted chamber. An annular array of elongated Perkins tubes is supported for rotation with the rotor and each Perkins tube extends through the partition, with the evaporation end section extending into the nonwetted chamber and the condensing end section extending into the wetted chamber. Each Perkins tube mounts a plurality of closely spaced heat conductive fins along its length, and a layer of porous metal is bonded to the entire inner surface of the evaporation section of the tube. A first inlet port introduces hot, dry outside air into the wetted chamber and a first outlet port vents the cooled but humidified air from the wetted chamber to the atmosphere or to a space to be conditioned. A second inlet port introduces atmospheric or compartment space air into the nonwetted chamber and a second outlet port vents cooled air from the nonwetted chamber for controlled mixing with the vented air from the first outlet port and delivery to a space to be conditioned. A water reservoir and pump supply water mist into the wetted chamber for wetting the finned heat transfer surfaces. A bootstrap mode may be provided by communicating outlet air duct 64 with inlet air duct 58 and outlet air duct 60 with the space 56. A controller valve 80 in inlet air duct 58 allows outside air to be mixed with air in duct 64.

26 Claims, 4 Drawing Sheets

20
18
22
12
30
64
34
32
60
42
2
3
3
30'
30
18
16
46
48
38
P
58
40
36
50
26

28
14
16
62
10
44
2
32
34
34
34
34
30'
30'

COMPACT ROTARY EVAPORATIVE COOLER

BACKGROUND OF THE INVENTION

This invention relates to the cooling of hot dry air by indirect or direct means, or a combination thereof, employing a compact apparatus which efficiently utilizes the capacity of dry air to evaporate water.

Evaporative coolers have been employed for many years to cool air in homes, farm buildings, commercial buildings, industrial buildings and to provide spot cooling. For example, spot evaporative coolers are sold commercially to cool air in workshops, garages, greenhouses, etc. The technology and apparatuses now available are described in Chapter 19 of ASHRAE's 1996 HVAC Systems and Equipment book and in Chapter 47 of ASHRAE's 1995 HVAC Applications book. A study of these references discloses that indirect cooling devices always are separated from direct cooling devices and these devices may be interconnected by air ducting to achieve desired synergistic cooling effects.

The process of evaporative cooling exchanges the latent heat of water for the sensible heat of air and, consequently, is environmentally benign. The mechanical energy that must be provided for this exchange is a small fraction of the energy required in the more conventional vapor compression devices for an equivalent amount of cooling. Evaporative cooling, however, is only effective as a stand-alone device in approximately one-half the land area of the world, wherein the dry bulb temperatures are 95° F. or higher and the concomitant wet bulb temperatures are 70° F. or lower.

SUMMARY OF THE INVENTION

The compact rotary evaporative cooler of this invention includes a hollow case mounting a rotor having a partition which divides the case longitudinally into a wetted-heat transfer surface chamber and a nonwetted-heat transfer surface chamber. An annular array of Perkins tubes is mounted longitudinally on the rotor for rotation therewith, and each tube extends through the partition with the evaporation section extending into the nonwetted chamber and the condensing end section extending into the wetted chamber. Each Perkins tube conductively mounts a plurality of longitudinally spaced, circumferential, heat conductive fins. A first inlet port introduces hot, dry outside air into the wetted chamber of the case and a first outlet port vents cooled but humidified air from the wetted chamber. A second inlet port introduces room or other compartment space or outside air into the nonwetted chamber and a second outlet port vents cooled air from the nonwetted chamber for controlled mixing with the vented air from the first outlet port for delivery to the space to be conditioned. A water reservoir and pump supplies water mist into the wetted chamber of the case for wetting the finned heat transfer surfaces in the wetted chamber.

It is the principal objective of this invention to provide a compact rotary evaporative cooler which can be easily integrated into applications where space and energy are at a premium.

Another objective of this invention is the provision of a compact rotary evaporative cooler of the class described having the ability to control the humidity of the cooled air to accommodate the varying preferences of occupants in conditioned spaces.

Still another objective of this invention is to provide a compact rotary evaporative cooler that is capable of providing cooling at a minimum expenditure of mechanical energy and, thereby, reduce the carbon dioxide burden in the atmosphere.

A further objective of this invention is the provision of a compact rotary evaporative cooler that functions without environmentally hazardous refrigerants and associated compression equipment.

A still further objective of this invention is to provide a compact rotary evaporative cooler of the class described that is of simplified construction for economical manufacture, maintenance and repair.

The foregoing and other objects and advantages of this invention will appear from the following detailed description, taken in connection with the accompanying drawings of a preferred embodiment.

DESCRIPTION OF THE PREFERRED EMBODIMENT

Figures 1, 4:
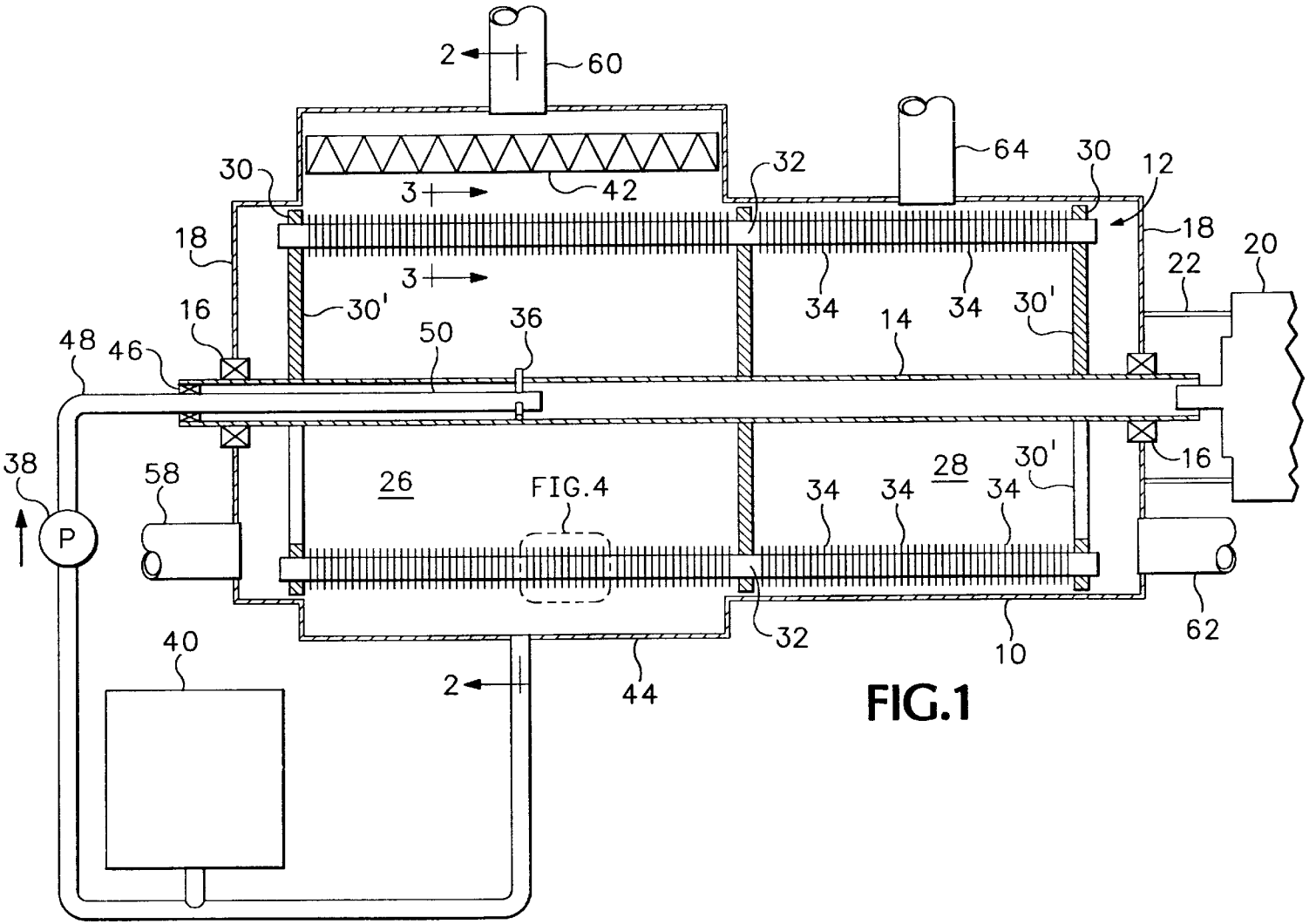
FIG. 1 is a fragmentary schematic longitudinal section of a compact rotary evaporative cooler embodying the features of this invention.
FIG. 4 is an enlarged fragmentary longitudinal portion of one of the Perkins tubes identified by the broken rectangle in FIG. 1.

As shown in FIG. 1, the compact rotary evaporative cooler of this invention includes an outer case 10 which is elongated and preferably substantially cylindrical in cross section. Case 10 houses a rotor indicated generally at 12. The rotor is mounted on and attached to a central shaft 14 rotating in bearings 16 which are supported by end walls 18 fixed to case 10.

The rotor is driven by a variable speed motor 20 which is attached by supports 22 to an end wall 18 of the case 10.

Shaft 14 mounts a substantially centrally disposed, radially extending partition plate or barrier plate 24. The plate is rigidly mounted on shaft 14 as by welding. Its diameter is but slightly less than the internal diameter of case 10.

Partition plate 24 accordingly divides the interior of case 10 into two chambers. A first chamber 26, termed herein as the wetted chamber, receives hot dry ambient air, and a second chamber 28, termed herein as the nonwetted chamber, receives either hot dry ambient air to be cooled and vented into a conditioned room/compartment space or air withdrawn from the room/compartment space.

Figure 2:
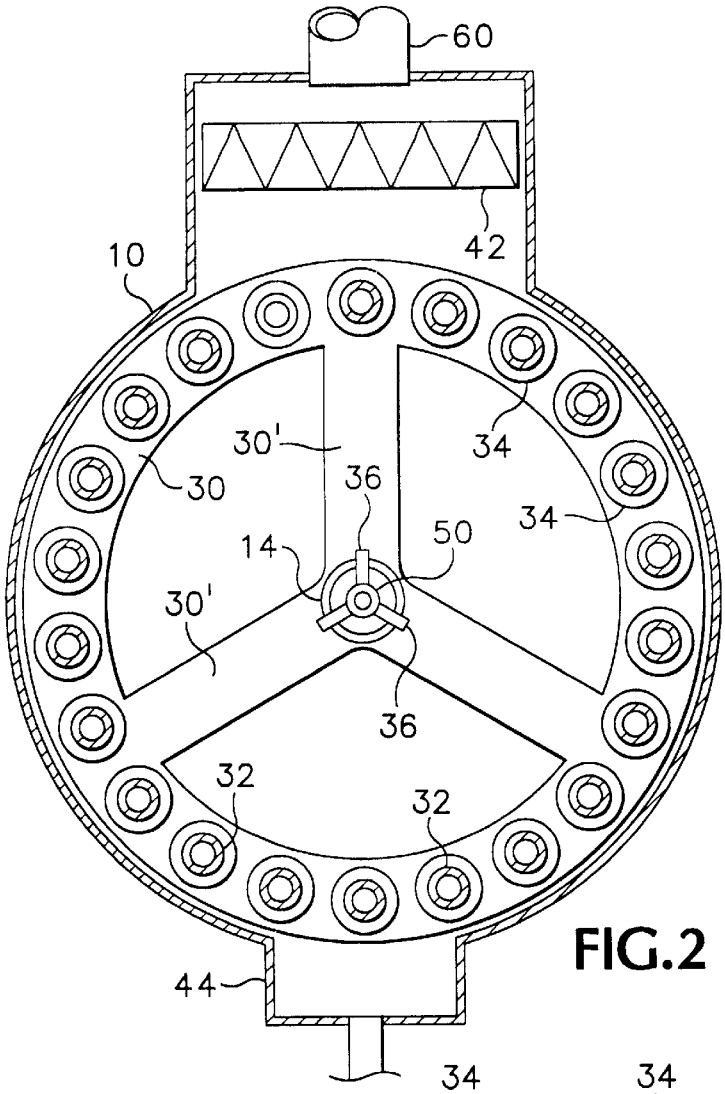
FIG. 2 is a transverse section taken on the line 2—2 in FIG. 1.

Rotor 12 also includes a pair of annular end plates 30, FIGS. 1 and 2, supported by spiders 30' rigidly connected to the central shaft 14. End plates 30 together with partition plate 24 and case 10 define wetted chamber 26 and nonwetted chamber 28.

Plates 24 and 30 mount an annular array of elongated Perkins tubes 32. The periphery of each Perkins tube is in thermal contact with and is surrounded by a plurality of annular heat conductive fins 34, FIGS. 3 and 4 spaced apart from 20 to 40 mils along the length of the tube. The evaporation end section of each Perkins tube registers with the nonwetted chamber 28 and the condensing section registers with the wetted chamber 26.

Within wetted chamber 26 are located a number of spray nozzles 36, FIG. 1 and FIG. 2 for spraying water mist onto the Perkins tubes and fins in the chamber 26. Water is supplied to the spray nozzles by pump 38 which obtains water from reservoir 40. Excess spray is returned to chamber 26 by demister 42 integrated with case 10 and collects in sump 44 also integrated with case 10. Bearing 46 provides a transition between the stationary water pipe 48 and the rotating water pipe 50 located within hollow, central shaft 14.

Figure 3:
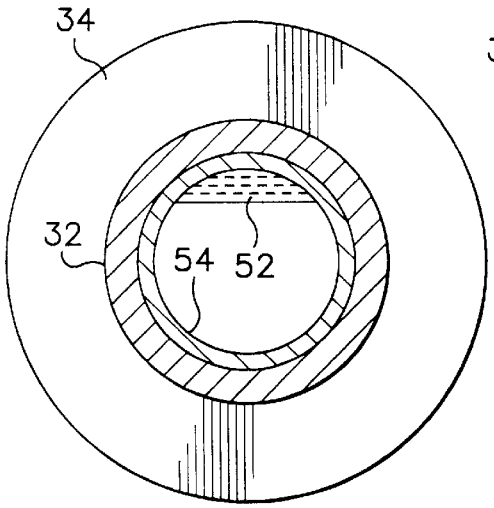
FIG. 3 is a transverse section, on an enlarged scale, taken on the line 3—3 in FIG. 1, showing a Perkins tube and its associated circumferential fin.
Figure 4:
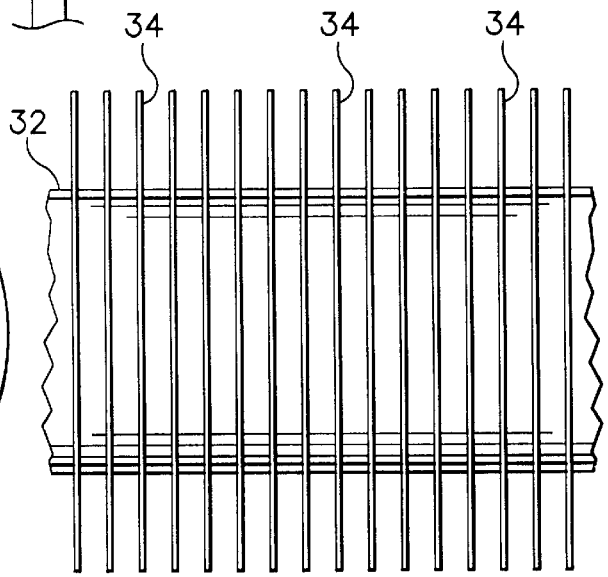

Each of the Perkins tube 32 is evacuated of all noncondensible gases and is charged with a small quantity of water 52 (FIG. 3), although other suitable heat transfer liquids may be employed. A thin porous layer of metal 54, between 20 and 80 mils in thickness, FIG. 3, is metallurgically fused onto the entire internal circumference of that part of the Perkins tube located in nonwetted chamber 28.

Figure 5:
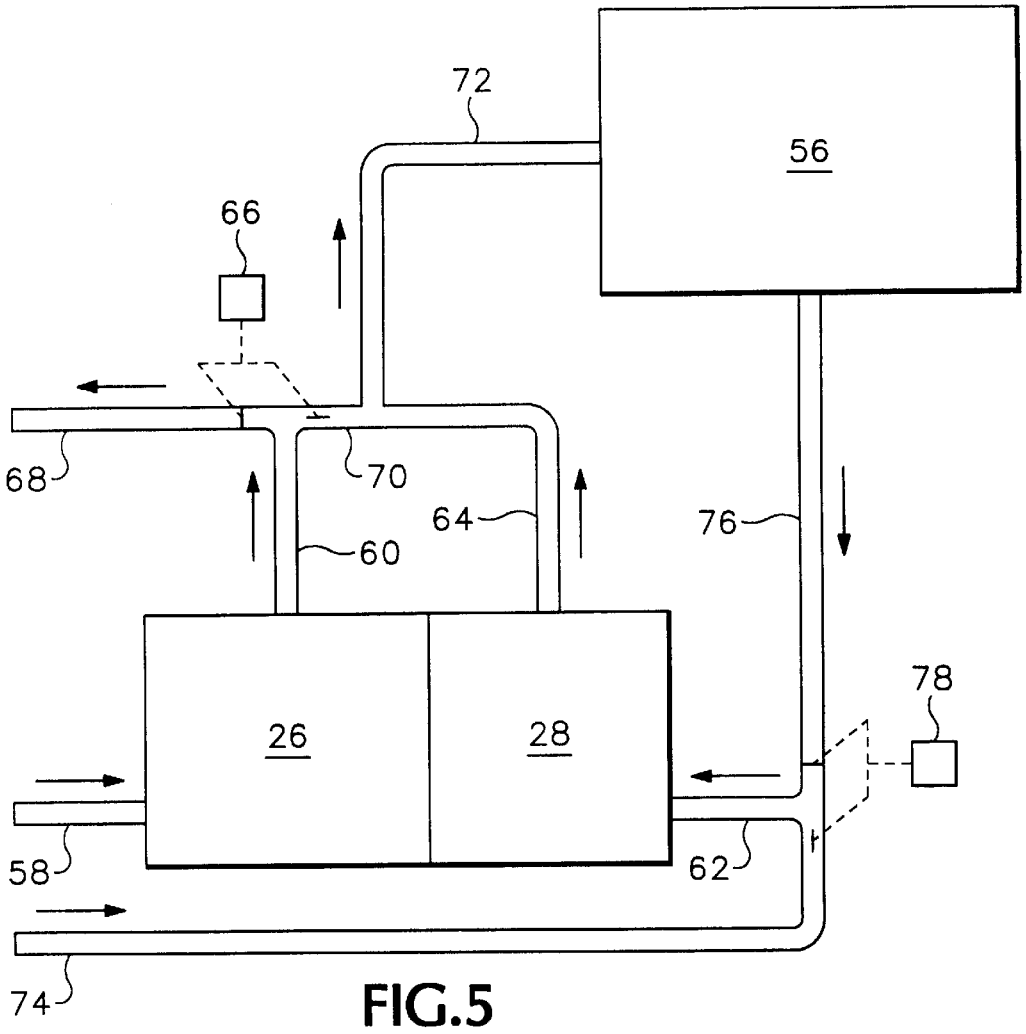
FIG. 5 is a schematic diagram illustrating one arrangement of integrating a compact rotary evaporative cooler of this invention into a room or other space to be conditioned.

FIG. 5 illustrates one method that may be employed to integrate the compact rotary evaporative cooler into a room/compartment space 56 which is to be conditioned. By virtue of rotation of rotor 12 within case 10, wetted chamber 26 supplies airflow from inlet air duct 58 to outlet air duct 60 and nonwetted chamber 28 supplies airflow from inlet air duct 62 to outlet air duct 64. Hot dry ambient air entering through inlet duct 58 is cooled and humidified by the evaporation of water from finned surfaces 34 in wetted chamber 26.

Additional water is evaporated from finned surfaces 34 in order to remove thermal energy transferred from nonwetted chamber 28 by the action of Perkins tubes 32. This additional thermal energy further increases the humidity of air exiting wetted chamber 26. Controller 66 actuates shutters in air duct 68 and air duct 70. The shutter linkage to the controller is such that when the shutter in air duct 68 is completely closed the shutter in air duct 70 is completely open. When this obtains, the airflow from wetted chamber 26 is all vented through air ducts 60, 70 and 72 to room/compartment space 56. Contrariwise, when the shutter in air duct 68 is completely open, the shutter in air duct 70 is completely closed and airflow from wetted chamber 26 is exhausted through duct 68 to the atmosphere. Intermediate controller settings between these extremes result in various fractions of the airflow from wetted chamber 26 being diverted to room/compartment 56.

Hot dry ambient air from air duct 74 or hot air from room/compartment space 56 through air duct 76 enters nonwetted chamber 28 through air duct 62. Controller 78 actuates shutters in air duct 74 and air duct 76. The shutter linkage to the controller is such that, when the shutter in air duct 74 is closed, the shutter in air duct 76 is completely open. When this obtains, only airflow from room/compartment space 56 enters nonwetted chamber 28. When the controller is actuated to the other extreme, all airflow from room/compartment space 56 is stopped and only hot dry ambient air enters nonwetted chamber 28 through air duct 74. It is understood that, as a practical matter, room/compartment space 56 is not hermetically tight and, therefore, airflow entering through air duct 72 escapes through various enclosure openings. The embodiment of controllers 66 and 78 permits the control of the humidity in room/compartment space 56 over a wide range and is essential to the proper operation of the compact rotary evaporative cooler.

Operation

As motor 20 spins rotor 12 within case 10, centrifugal forces are developed which are a maximum at the Perkins tubes 32 and associated fins 34.

The function of the Perkins tubes 32 is to transfer thermal energy from the nonwetted chamber 28 to the wetted chamber 26. This thermal energy must be transferred without significant temperature loss when the Perkins tube is operating in a high centrifugal force field. This requirement can only obtain if the internal evaporative heat transfer coefficient in the Perkins tube is high in the non-wetted chamber 28 and if the internal condensing heat transfer coefficient in the Perkins tube is high in the wetted chamber 26.

Internal condensing heat transfer coefficients on bare metal surfaces are normally high and increase under the influence of a centrifugal force field by the one-fourth power of the force field when expressed as the number of gravities. If a portion of the internal heat transfer surface is covered by liquid then, in this area, the internal condensing heat transfer coefficient is very low since all nonmetal liquids act, by comparison, as insulators. As a consequence, the amount of liquid water 52, FIG. 3, must not cover more than about 25% of the internal condensing area of the Perkins tube. This small amount of liquid is not sufficient to permit the Perkins tube to transport practical quantities of thermal energy under normal gravity conditions. This is because the friction slope characteristic in terms of inches of slope per foot of length of liquids flowing in open channels is an order of magnitude greater than the maximum depth of liquid water 52 when the Perkins tube is transporting practical amounts of thermal energy. At the centrifugal force fields of 100 to 200 times those of normal gravity at the radial location of the Perkins tubes, which are typical of the force fields of practical compact rotary evaporative coolers of this invention, the flow of liquid water 52 from the condenser section to the evaporator section is more than sufficient to sustain practical amounts of thermal energy. This is because the friction slope is inversely proportional to the force field expressed by the number of gravities.

The internal evaporative heat transfer coefficient can only be made large in high centrifugal force fields by means of porous metallic surface 54, FIG. 3. This surface must be metallurgically bonded to the entire inside surface of the Perkins tube evaporator section located in the nonwetted chamber 28 and it must be capable of wicking the liquid water 52 around the entire inner surface of Perkins tube 32 in sufficient quantity to provide the mass flow of vapor required by the thermal requirements of the compact rotary evaporative cooler. The quantity of liquid that can be transported by the porous surface is determined by the mean size of the pores and the thickness of the surface, and the wicking ability of the porous surface is determined by the mean pore size.

The behavior and construction of porous surfaces is taught in U.S. Pat. Nos. 3,384,154 and 3,523,577 wherein it is shown that porous copper surfaces attain evaporative heat transfer coefficients of several thousand Btu/hr-ft$^{2}$° F. even when boiling poor heat transfer liquids such as liquid oxygen. For the purposes of the present invention, the mean pore size must be about 0.25 mils in diameter in order to provide sufficient wicking heights to pump the liquid water around the inner diameter of Perkins tubes of reasonable size in centrifugal force fields of 100 to 200 gravities. It has been shown, unlike the teachings of the preceding cited patents, that in order to obtain a satisfactory mean pore diameter of this size, the porous surface must be either compressed prior to sintering or the sintering temperature must be increased.

The property of a porous surface which determines the quantity of water that it is able to pump by wicking is termed permeability. The permeability increases as approximately the square of the mean pore size. The permeability of porous wicks suitable for purposes of this invention is between 0.05 and 0.2 darcy, preferably about 0.1 darcy. At this permeability, the thickness of porous surface 54 must be between 20 and 80 mils, preferably about 40 mils, in order to carry sufficient water around the circumference to supply the quantity of water evaporating from the surface during operation.

The movement of liquid and vapor within Perkins tube 32 operating in a centrifugal force field of 100 to 200 gravities is thus. Thermal energy is extracted by means of evaporating the working fluid in the Perkins tube from the porous surface within the Perkins tubes located in nonwetted chamber 28 and deposited in wetted chamber 26 by means of condensing the vapors of the working fluid within the Perkins tubes located in the wetted chamber. Within the Perkins tube, the thermal energy is extracted as latent heat in the evaporation of water contained in porous surface 54. This vapor flows through the hollow center of the Perkins tube to the portion of the tube in wetted chamber 26 wherein it releases its latent heat by condensing on the cold tube-wall surface. The condensing liquid adds to the liquid water 52, slightly increasing the amount of liquid within this portion of the Perkins tube located in wetted chamber 26. The increase in depth of water that can exist in the presence of equilibrating centrifugal forces is restricted. At 100 gravities and a thermal load of 500 Btu/hr, the friction slope is 1.2 mils per foot of Perkins tube length. For a typical ½-inch inside diameter Perkins tube of one foot length, this represents an increase of about 10% of the maximum liquid water 52 depth. At 200 gravities, this percentage reduces to approximately 5%.

Consequently, liquid water 52 has substantially the same cross sectional profile in the Perkins tube portions located in wetted chamber 26 and nonwetted chamber 28. In the nonwetted chamber, the liquid is pumped through the porous surface along the inner wall of the Perkins tube towards the center of rotation and, thus, against the centrifugal force field. For a typical ½-inch inside diameter Perkins tube operating in a force field of 100 gravities, the pumping height of the porous surface must be at least 50 inches in order for the liquid to completely circumvent the inside surface. Simultaneously, as liquid is being pumped along the diametrically opposing surfaces from the two edges of liquid water 52, liquid is being extracted from the porous surface by the process of evaporation. The pumping height must be sufficient to overcome the frictional losses of the liquid flowing through the porous surface by virtue of evaporation of liquid from its surface. For the design of Perkins tubes suitable for compact rotary evaporative coolers of this invention, the pumping or wicking height of the porous surface should be about 10% greater than the minimum calculated by multiplying the inside diameter of the Perkins tube by the force field expressed as the number of gravities.

In wetted chamber 26, the surfaces of fins 34 are wetted by spray nozzles 36 while rotor 12 is rotating. The spacing between fins 34 is about 30 mils (0.76 mm). In the high centrifugal force field, water-bridging (which is encountered in normal gravity) between fins due to the surface tension of water is avoided. Furthermore, the dry-air heat transfer is determined uniquely by the thermal conductivity of air; that is, reducing the spacing proportionally increases the heat transfer coefficient and increasing the spacing proportionally reduces the heat transfer coefficient. This obtains because the thickness of the boundary layer of flowing air which is the recognized impediment to heat transfer cannot exceed one-half of the spacing between fins. By reducing the spacing between fins, the convective heat transfer coefficient and the dependent mass transfer coefficient are increased and the size of the compact rotary evaporative cooler is, therefore, reduced.

The air flowing by the wetted-fin surface behaves exactly as does the air flowing by the wet bulb thermometer on the familiar sling psychrometer; that is, the fin surface temperature approaches the wet bulb temperature. The efficiency of these heat and mass transfer processes is determined by the convective heat transfer coefficient and by the mass transfer coefficient. For a Lewis of number 1, which is approximately true for air and water vapor mixtures, the mass transfer coefficient is equal to the convective heat transfer coefficient divided by the specific heat capacity of the entering air. The unit of the mass transfer coefficient is, therefore, in pounds per hour per foot square where pounds indicates the weight of moisture evaporated, per hour indicates the time for this moisture to evaporate, and the foot square indicates the area over which the evaporation occurs. For every pound of water that evaporates at 80° F., 1048.6 Btu of thermal energy is extracted from the air and finned surfaces. Just as temperature difference is the driving potential for convective heat transfer, the absolute humidity difference is the driving potential for mass transfer.

The rate at which thermal energy is extracted from the air and finned surfaces is also determined by the rate of airflow across the finned surfaces. The rate of airflow is proportional to the speed of rotation of rotor 12. Since the rate of airflow is determined by the centrifugal force on the radial column of air between fins 34, the rate of airflow will be identical between all fins if the fin spacing is the same. This ideal uniformity in the rate of airflow characteristic of rotary heat exchangers cannot be duplicated in the uniformity of the rate of airflow between fins in stationary heat exchangers wherein a blower is used to provide airflow. This is because the airflow from a blower is turbulent and is not uniform.

The ability of the rotor to generate a uniform airflow between and within small air channels has profound implications on the performance and efficiency of the compact rotary evaporative cooler. Each of the many airflow channels in the rotor accepts a portion of the inlet air in accordance with the rotor design and its speed of rotation. In the wetted chamber 26, the air contains droplets of water, is at a high dry bulb and a low wet bulb temperature. The water drops impinge upon the surfaces of fins 34 and, consequently, these surfaces are wetted. The absolute humidity at the wetted surfaces, in terms of pounds of water per pound of dry air, approaches saturation. The fin surface is slightly heated by the incoming air and by the thermal energy being transported through the Perkins tube from nonwetted chamber 28. If it is assumed that a minimal transfer of thermal energy occurs between the water droplets and the incoming air, the fin surface temperature at the inner diameter of rotor 12 in wetted chamber 26 will be near the dew point temperature of the ambient air. The fin surface temperature increases progressively as a position on the finned surface moves radially outward until it reaches its highest value at the outer diameter of the rotor. Because of the very high heat of vaporization of water, the fin surface temperature increases only a few degrees Fahrenheit between the inner and outer finned-surface radii of rotor 12.

The operation of wetted chamber 26 involves two distinct processes. In the first process, the ambient air is humidified and its dry bulb temperature is reduced. This process is adiabatic and the finned surfaces of rotor 12 in wetted chamber 26 behave exactly as contactors which are employed in gas humidification-cooling towers. In the second process, the finned surface operates to extract heat from the Perkins tube and, by means of evaporation of water on the surface, heat is extracted from the fins and the humidity in the airstream is increased beyond the increase in humidity normally associated with adiabatic operation. The product of this increase in humidity, the mass of airflow in wetted chamber 26, and the heat of vaporization of water equals the heat extracted from nonwetted chamber 28 by Perkins tubes 32. Because the finned surfaces are operating in high force fields, the thickness of the wetted film on the finned surfaces is much thinner than the thickness of wetted films on conventional heat exchanger surfaces. This thin film insures that the fin surface temperature is very close to the film temperature.

The operation of nonwetted chamber 28 involves only one process. The air entering chamber 28 is cooled without any change in its absolute humidity—that is, moisture is neither added nor withdrawn from the air. For example, air at a dry bulb temperature of 95° F. and at a wet bulb temperature of 65° F. has an absolute humidity of 0.00640 pounds of moisture per pound of dry air and a relative humidity of 18%. If the dry bulb temperature is reduced to 75° F, the wet bulb temperature is reduced to 58° F., the absolute humidity is not changed but the relative humidity, which is the measure of the capacity of air to hold moisture, is increased to 34%.

Throughout the world, humans dressed in summer clothing are comfortable at a temperature of 77° F. and a relative humidity of 50% during primarily sedentary activities. Discomfort occurs when the relative humidity exceeds 65% because of the induced feeling of moisture. Discomfort, in the form of dryness in the nose, eyes, and throat, occurs when the relative humidity is less than 20%. Clearly, the abiliy to control room/compartment humidity by manipulating controllers 66 and 78 enhances the practicality of the compact rotary evaporative cooler of this invention.

Water usage is approximately one gallon of water for every 9000 Btu/hr of cooling. The portion of this cooling usable in conditioning the room/compartment is, of course, dependent upon the humidity control desired by the occupants. If the 50% relative humidity prevails, then about 90% of the cooling is available to condition the air in the room/compartment.

The quality of the water must be controlled if water usage is to be minimized and if long-term and safe operation of the system is to be enjoyed. Demister 42 is provided to conserve water by removing airborne droplets flung off the outer rims of fins 34 in wetted chamber 26. These droplets are collected and coalesced and returned to sump 44 for recirculation to the sprays by pump 38. Tap water contains minerals which, over time, will build up on finned surfaces 34. These minerals may be removed by chemical treatment; however, it is preferred to employ rain or demineralized water in this service. For applications where water usage is not as important, a small fraction of the water in sump 44 may be discharged to the drain in order to maintain the mineral content at acceptable levels.

EXAMPLE

The performance of a small compact rotary evaporative cooler, wherein the aforementioned features are incorporated, was investigated.

The outside diameter of rotor 12 is 8 inches (20.3 cm) and its inside diamater is 6 inches (15.2 cm). The total length of the rotor is 27 inches (68.6 cm). Partition plate 24 is positioned asymmetrically such that the axial length between the partition plate and end plate 30 in the wetted chamber is 15 inches (38.1 cm); and, in the nonwetted chamber, the axial length is 12 inches (30.5 cm). The fins 34 are 0.010-inch (0.25 mm) thick aluminum and the space between adjacent fins is 0.030 inch (0.76 mm); consequently, there are 25 fins per linear axial inch (2.54 cm) (in both chambers). The surfaces of the fins in wetted chamber 26 are etched by dipping in Oakite 360L (made by Oakite Products, Inc.) so that they are wetted by the water spray. Motor 20 drives rotor 12 at (a nominal speed of) 1200 rpm; therefore, the centrifugal force field at the centerline of the Perkins tubes is 143 gravities.

The inside diameter of each Perkins tube 32 is 0.5 inch (12.7 mm) and the outside diameter is 0.55 inch (14 mm). The Perkins-tube material is copper and there are 22 Perkins tubes in rotor 12. In the portion of each Perkins tube that extends into nonwetted chamber 28, there is a sintered 0.04-inch (1 mm) thick porous surface that is bonded to the entire inside diameter. The porous surface material is copper. The mean pore diameter is 0.25 mil (6.35 microns); therefore, the wicking height under normal gravity conditions is 71 inches (180 cm) when the fluid is water. The permeability of this wick is 0.1 darcy.

Each Perkins tube 32 is evacuated of all noncondensible gases and is charged with 0.6 cubic inch (9.83 cubic cm) of deaerated and deionized water. This charge results in 25% of the inside area of the condenser being covered by liquid and 10% of the inside area of the evaporator being covered by liquid. Typically, each Perkins tube transports about 500 Btu/hr of thermal energy which results in a condenser heat flux of 4167 Btu/hr-ft$^2$ and an evaporator heat flux of 5000 Btu/hr-ft$^2$. The condensing heat transfer coefficient at the above condenser heat flux and in a centrifugal force field of 143 gravities is 12,000 Btu/hr-ft$^{2\circ}$ F. U.S. Pat. No. 3,523,577 teaches that the evaporative heat transfer coefficient for liquid oxygen at a heat flux of 5000 Btu/hr-ft$^2$ is 5000 Btu/hr-ft$^{2\circ}$ F. for a copper porous surface. It is known that at reasonably high heat fluxes, as the pore size increases, the evaporative heat transfer coefficient decreases inversely as the square root of the pore size. It is also known that, as the heat flux increases, the evaporative heat transfer coefficient increases as the 0.6 power of the heat flux. If the heat flux is too low to activate the pores, the evaporative heat transfer coefficient for a porous surface is identical to the evaporative heat transfer coefficient for a nonporous surface. Finally, the evaporative heat transfer coefficient is determined by the fluid properties at the evaporating temperature. Tests were conducted on a ⅜-inch (9.5 mm) I.D. copper tube onto the inside of which was sintered a 93.5-mil (2.37 mm) thick copper porous surface which had a porosity of 38%. The tube was evacuated of all noncondensible gases and charged with sufficient distilled water to completely saturate the porous surface. At a heat flux of 10,000 Btu/hr-ft$^2$, the pseudo evaporative heat transfer coefficient was determined to be 10,900 Btu/hr-ft$^{2\circ}$ F. Since this pseudo coefficient includes the temperature drop through the rather thick porous surface, the actual evaporative heat transfer coefficient is considerably higher than this value. For the conditions of the present example, the radial distance from the surface of the liquid water to the outermost part of the porous wick is 0.45 inch (11.4 mm); pumping at the outermost portion of the wick will cease at 158 gravities which provides the desired 10% operating margin.

The Perkins tube of this invention is characterized by very low internal thermal resistance when operating in the centrifugal force fields of 100 to 200 gravities. When the Perkins tube is transporting 500 Btu/hr from the nonwetted chamber to the wetted chamber, the irretrievable temperature loss within the tube is 0.9° F. Without the presence of a porous wick of the characteristics specified, the irretrievable temperature loss determined using prior art technology is 23° F. Obviously, 23° F. is an unacceptably large percentage of the total temperature potential available to drive the evaporative cooling process.

Air is forced out radially through the circumference of a spinning finned rotor. The quantity of airflow is directly proportional to the speed of rotation, and directly proportional to the diameter and length of the rotor. This proportionality applies if the annular spacing between fins is less than approximately 0.08 inch (2 mm). For the selected example rotor, it has been determined by extrapolating experimental data that, at a rotor speed of 1200 rpm, the wetted chamber free-flow airflow is 575 SCFM (Standard Cubic Feet per Minute) and the nonwetted chamber free-flow airflow is 460 SCFM.

Consider an ambient dry bulb temperature of 95° F. and a wet bulb temperature of 65° F. The relative humidity at these conditions is 18%. Consider, further, that ambient air enters the nonwetted chamber; that is, controller 78 actuates the shutter in air duct 74 so that it is completely open and the shutter in air duct 76 is completely closed. Further, controller 66 adjusts shutters in air duct 68 and air duct 70 such that the airflow in air duct 72 is 920 SCFM; that is 460 SCFM of the 575 SCFM exiting the wetted chambers is mixed with 460 SCFM of air exiting the nonwetted chamber.

Figure 6:
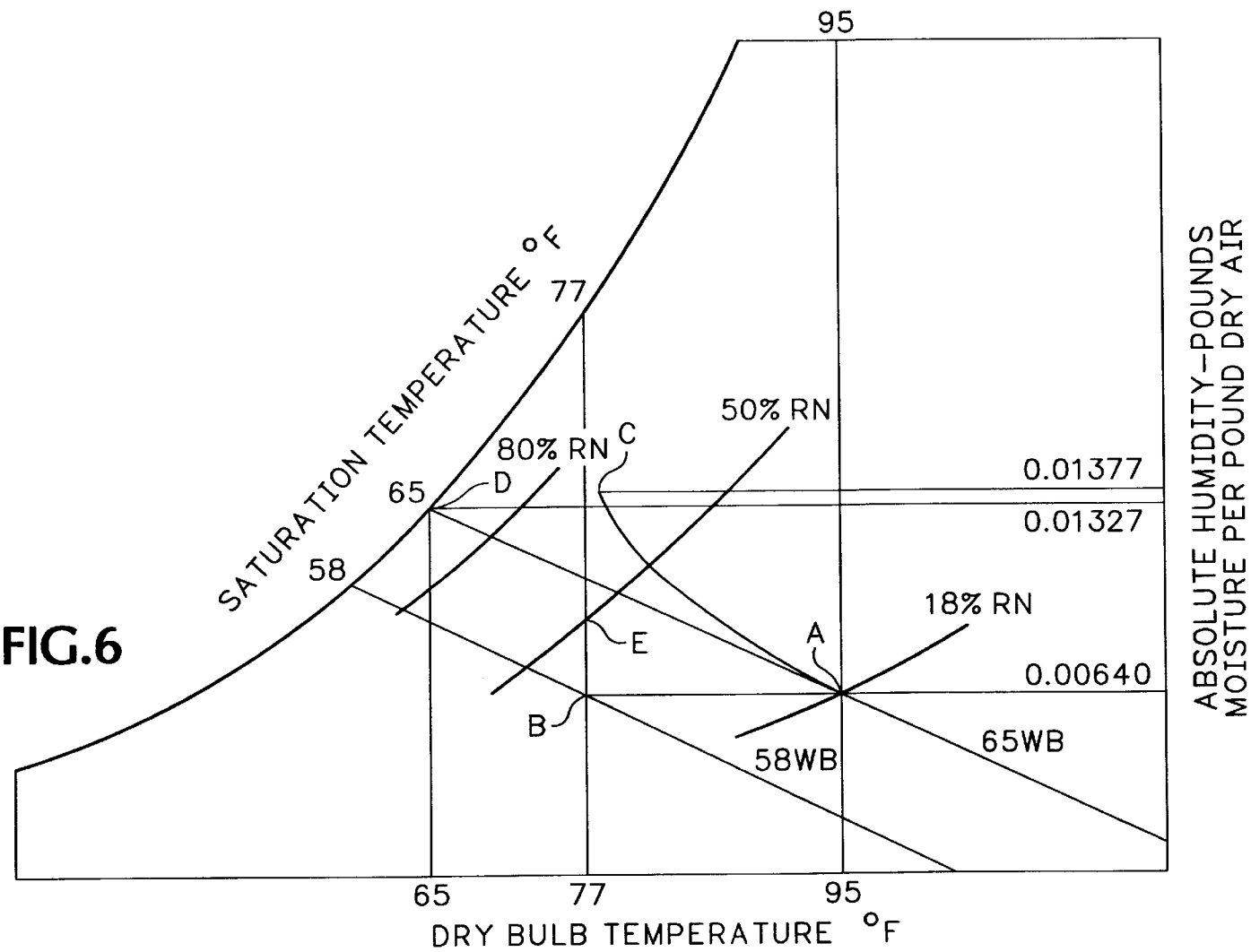
FIG. 6 is a psychrometric chart illustrating the performance parameters of the compact rotary evaporative cooler of FIG. 1 integrated as illustrated in FIG. 5.

The conditions of the thermal behavior of the various airstreams obtaining as the result of the operation of the compact rotary evaporator cooler in the specified ambient environment is illustrated on the psychrometric chart, FIG. 6. The ambient environment is represented by point A; at which condition the absolute humidity is 0.00640 pounds of moisture per pound of dry air. As the air temperature passing through the finned Perkins tubes 32 in the nonwetted chamber 28 cools, the absolute humidity does not change; however, the relative humidity (RH) increases because cool air cannot hold as much moisture as hot air. The air passing through the nonwetted chamber follows the constant absolute humidity line designated A-B.

The outside air passing through the finned Perkins tubes in the wetted chamber is cooled and humidified along the line A-C, FIG. 6. Two simultaneous processes occur. The first process is the adiabatic cooling and humidification of the air along line A-D. The wetted fins behave identically to the wetted packings in an adiabatic humidification column. At the liquid-gas interface, the absolute humidity is determined by the temperature of the finned surface which approaches the wet bulb (WB) temperature of 65° F. at equilibrium conditions. The absolute humidity at saturation and at a wet bulb temperature of 65° F. is 0.01327 pounds of moisture per pound of dry air. The driving potential for humidification is the difference between the absolute humidity of the liquid-gas interface and the ambient air which is 0.01327−0.00640=0.00687 pounds of moisture per pound of dry air at the inner radius of the fins in wetted chamber 26. As the air moves from the inner to the outer radius of the fins, its humidity is increased and its temperature is decreased along line A-D of psychrometric chart, FIG. 6.

Superimposed on the first process is the nonadiabatic process obtaining as a consequence of thermal energy extracted from the hot air in nonwetted chamber 28 and transferred through the Perkins tubes to the fins in the wetted chamber 26. This thermal energy slightly raises the temperature of the surface of the fins and, therefore, slightly increases the absolute humidity of the liquid-gas interface at the inner radius. The combined adiabatic and nonadiabatic processes decrease the air temperature and increase the absolute humidity along line A-C of the psychrometric chart. The conditions at the various points labeled in the psychrometric chart are listed in Table I.

TABLE I

| | Temperature | | Humidity |
|---|---|---|---|
| Point | Dry Bulb ° F. | Wet Bulb ° F. | Absolute #Moisture/#DA |
| A | 95 | 65 | 0.00640 |
| B | 77 | 58 | 0.00640 |
| C | 77.3 | 69 | 0.01377 |
| D | 65 | 65 | 0.01327 |
| E | 77 | 64 | 0.01009 |

Note that the absolute humidity of the air exiting the wetted chamber is 0.01377 and is slightly greater than the saturated absolute humidity at 65° F. At the outer radius of the fins 34 in the wetted chamber 26, the fin surface temperature is 67° F. and the absolute humidity at the liquid-gas interface is 0.01425 pounds of moisture per pound of dry air; therefore, the absolute humidity potential for evaporating water from the finned surface remains.

The thermal energy extracted from the airstream in the nonwetted chamber is 9149 Btu/hr. and the thermal energy extracted from the airstream in the wetted chamber is 10,977 Btu/hr. The quantity of water evaporated from the finned surfaces in the wetted chamber is (0.01377−0.00640)(575×0.075×60)=19.07 pounds (8.7 Kg) per hour where 575 is the SCFM airflow, 0.075 is the standard air density, and 60 is the number of minutes in an hour. The heat of vaporization of water at the mean fin surface temperature of 66° F. is 1056.5 Btu/pound of water evaporated. Therefore, the evaporation of 19.07 pounds (8.7 Kg) of water per hour extracts 20,147 Btu/hr from the incoming air in both the wetted and nonwetted chambers. The slight discrepancy in the heat balance is caused by rounding off the values of the exhaust temperatures exiting the wetted and nonwetted chambers.

The relative humidity at point B on the psychrometric chart (FIG. 6) is 33% and at point C it is 67%. Controller 66 may be manipulated such that 460 SCFM of the 575 SCFM airflow exiting air duct 60 is diverted through duct 70 into air duct 72 to be combined with 460 SCFM of the airflow exiting nonwetted chamber 28 through air duct 64. The combined airflow in air duct 72 is, therefore, 920 SCFM and the absolute humidity is 0.0101 (4.6 g) pounds of moisture per pound of dry air. The air entering room compartment space 56 will be at a temperature of 77° F. and at a relative humidity of 50%—point E on the psychrometric chart. The cooling capacity of the compact rotary evaporative cooler is approximately 1.5 tons at these conditions.

Alternative Embodiments

Pump 38 may be driven by and be integral with shaft 14. The capacity of a rotary pump is proportional to the speed of rotation. The pumping head is generally proportional to the square of the speed of rotation. The spray capacity of a direct pressure nozzle is proportional to the square root of the pressure head. Consequently, the capacity of a direct pressure nozzle is directly proportional to the speed of rotation of the rotor. Because the capacity of the compact rotary evaporative cooler is proportional to speed, mounting the pump on the rotor permits the spray flow to automatically adjust to capacity.

Spray nozzles 36 are located on central shaft 14 in the preferred embodiment. Typically, three PJ8 type ¼-inch nozzles, manufactured by Bete Fog Nozzle, Inc., operating at 50 psi and at a flow rate of 0.76 gallons (2.88 liters) per hour each are employed. These direct pressure nozzles produce a high percentage of water droplets under 50 microns. It is known that water droplets of this size have a settling rate of 0.3 foot per second in a normal gravity field which is small when compared to a rotor inlet air velocity of 50 feet per second. Consequently, an alternate location for a nozzle is one PJ15 type ¼-inch (6.4 mm) nozzle attached to the vertical end wall 18 of case 10. This nozzle has a capacity of 2.46 gallons (9.31 liters) per hour which is equivalent to 20.52 pounds (9.31 kg) per hour of water at a pressure of 50 psi.

Rain or demineralized water is recommended for use in the compact rotary evaporative cooler. If mineral containing water is employed, commercially available descaler chemicals should be used periodically. Bacteria and algae buildup may occur and periodic treatment with commercially available chemicals may be required when the environment is unusually dirty.

The small amount of mechanical energy needed to operate the compact rotary evaporative cooler may be supplied by electric, wind, water, or animal power, whichever is available in the location of its use.

Figure 7:
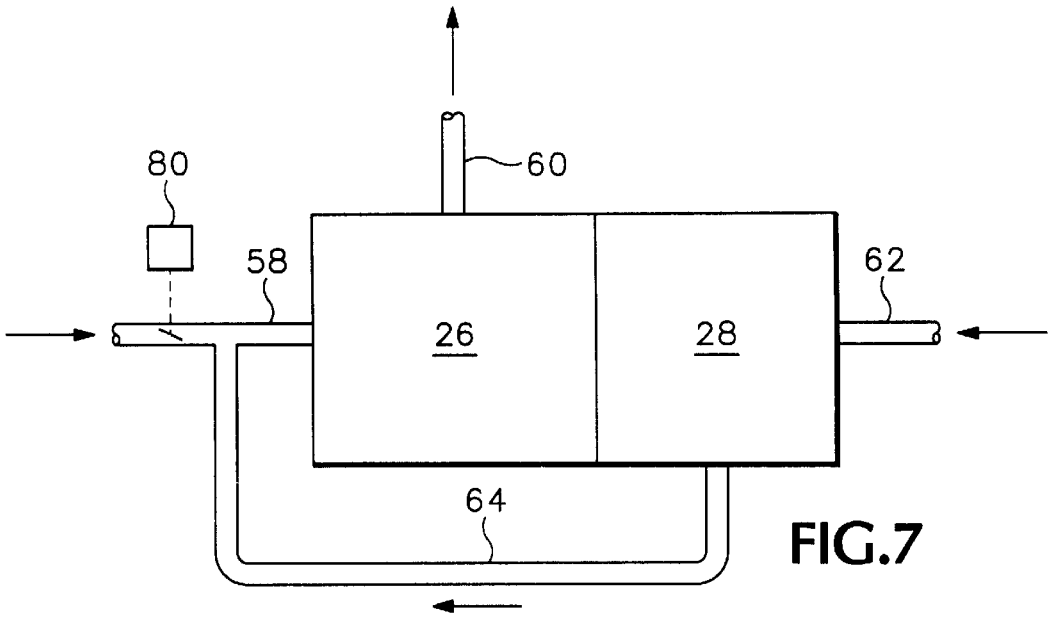
FIG. 7 is a fragmentary schematic diagram, similar to FIG. 5, illustrating a bootstrap mode of operating the compact rotary evaporative cooler of this invention.

The compact rotary evaporative cooler may be operated in a bootstrap mode. Referring to FIG. 7, the configuration of FIG. 5 is modified by communicating outlet air duct 64 with inlet air duct 58 and communicating outlet air duct 60 with the space 56 to be conditioned. A controller 80 in inlet air duct 58 is operable to permit a small quantity of outside air to enter duct 58 and be mixed with the quantity of air in duct 64 in order to supply the airflow requirements of wetted chamber 26.

When outside air of say 95° F. DB, 65° F. WB is cooled by extracting heat, both the dry bulb and wet bulb temperatures decrease as noted on FIG. 6, points A and B. If the air at a lower dry bulb and wet bulb temperature is now caused to flow into the wetted chamber, the wetted surface will approach 58° F. instead of 65° F. which was cited in the example. Consequently, the dry bulb temperature of the air in air duct 60 will be lower than that cited in the example. As stated, the air conditions in air duct 60 are 575 SCFM, 69° F. DB, and 65° F. WB. At these conditions, the relative humidity is 80% which is considered too high for human comfort but is probably acceptable for other usage.

In the example cited, the airflow in air duct 64 is 460 SCFM and the airflow in air duct 58 is 575 SCFM; therefore, the 115 SCFM deficiency must be supplied by outside air. The air conditions entering wetted chamber 26 are 77.6° F. DB, 59° F. WB, when 95° F. DB, 65° F. WB air enters nonwetted chamber 28 through air duct 62. The air conditions in air duct 60 are 575 SCFM, 69° F. DB, 65° F. WB. Water usage is 1.8 gallons (6.81 liters) per hour and the cooling capacity is 1.3 tons. The bootstrap operating mode results in lower air temperatures at the expense of higher values of relative humidity. The design of the compact rotary evaporative cooler may be optimized to yield the most favorable combinations of dry bulb and relative humidity output air conditions.

It will be apparent to those skilled in the art that various changes may be made in the size, shape, type, number and arrangement of parts described hereinbefore, without departing from the spirit of this invention and the scope of the appended claims.

I claim:

1. A rotary evaporative cooler having a plurality of Perkins tubes mounted for rotation in an annular array, each Perkins tube being characterized by an internal thermal resistance sufficiently low that when transporting 500 Btu/hr the irretrievable temperature loss is less than 1° F.

2. The rotary evaporative cooler of claim 1 wherein each Perkins tube has opposite evaporation and condensation end sections and a layer of porous metal is bonded to the internal surfaces of the evaporation section, the permeability of said porous metal being between 0.05 and 0.2 darcy.

3. The rotary evaporative cooler of claim 1 including a plurality of outwardly projecting heat conductive fins spaced apart between 20 and 40 mils along the length of and in thermal contact with the outer surfaces of the Perkins tubes.

4. The rotary evaporative cooler of claim 3 including water spray means for supplying cooling water to the exterior surfaces of the fins on the Perkins tubes.

5. The rotary evaporative cooler of claim 1 wherein each Perkins tube is evacuated of noncondensible gases and is charged with a small quantity of heat transfer liquid.

6. The rotary evaporative cooler of claim 5 wherein the amount of liquid in each Perkins tube is capable of covering a maximum of about 25% of the internal condensing area of the tube.

7. The rotary evaporative cooler of claim 1 wherein the rotational speed of the annular array produces a centrifugal force field of about 100–200 gravities.

8. The rotary evaporative cooler of claim 1 including a hollow elongated case containing the annular array of Perkins tubes and having a partition separating the case longitudinally into a wetted chamber and a nonwetted chamber, the Perkins tubes extending through the partition, each Perkins tube having an evaporation section registering with the nonwetted section and a condensing section registering with the wetted section, air inlet means in the case for introducing air thereinto, and air outlet means in the case for exhausting air therefrom.

9. The rotary evaporative cooler of claim 8 including water spray means in the wetted chamber for supplying cooling water to the exterior surface of the Perkins tubes.

10. The rotary evaporative cooler of claim 9 wherein the rotational speed of the annular array produces a centrifugal force field of about 100–200 gravities.

11. The rotary evaporative cooler of claim 8 wherein the air inlet means comprises a first air inlet in the case for introducing air into the wetted chamber for humidifying the air, and the air outlet means comprises a first air outlet in the case for exhausting the humidified air from the wetted chamber.

12. The rotary evaporative cooler of claim 11 including valve means operatively associated with the first air outlet for directing the humidified air selectively to the atmosphere and to a space to be conditioned.

13. The rotary evaporative cooler of claim 11 wherein the air inlet means includes a second air inlet in the case for introducing air into the nonwetted chamber for cooling the air, and the air outlet means includes a second air outlet in the case for exhausting the cooled air from the nonwetted chamber to a space to be conditioned.

14. The rotary evaporative cooler of claim 13 including valve means operatively associated with the second air inlet for selectively introducing into the nonwetted chamber air from the atmosphere and from a space to be conditioned.

15. The rotary evaporative cooler of claim 13 including valve means for combining the air outputs from the first and second outlets for delivery to a space to be conditioned.

16. The rotary evaporative cooler of claim 13 wherein the second air outlet is coupled to the first air inlet.

17. The rotary evaporative cooler of claim 16 including valve means in the first air inlet upstream from the second air outlet coupling, for varying the amount of inlet air for mixing with the air from the second air outlet.

18. The rotary evaporative cooler of claim 13 including valve means operatively associated with the first and second outlets for combining the air outputs from the first and second outlets for delivery to a space to be conditioned, and valve means operatively associated with the second air inlet for selectively introducing into the nonwetted chamber air from the atmosphere and from a space to be conditioned.

19. The rotary evaporative cooler of claim 18 including valve control means operatively associated with the valve means in the first air outlet and second air inlet for adjusting the humidity of the air delivered to the space to be conditioned.

20. The rotary evaporative cooler of claim 8 including:

a) a layer of porous metal bonded to the internal surfaces of the evaporation sections of the Perkins tubes in the nonwetted chamber, the layer of porous metal having a permeability of between 0.05 and 0.2 darcy and a thickness of between 20 and 80 mils, b) a plurality of outwardly projecting heat conductive fins spaced apart about 20 to 40 mils along the length of and in thermal contact with the outer surfaces of the Perkins tubes, c) water spray means in the wetted chamber for supplying cooling water to the exterior surfaces of the fins on the Perkins tubes, d) each Perkins tube being evacuated of noncondensible gases and being charged with a small quantity of liquid, e) the amount of liquid in each Perkins tube being capable of covering a maximum of about 25% of the internal condensing area of the tube, and f) the rotational speed of the rotor producing a centrifugal force field of about 100–200 gravities.

21. A rotary evaporative cooler, comprising:

a) a hollow elongated case, b) an elongated rotor in the case, mounted for axial rotation therein, c) a partition mounted for rotation with the rotor and separating the case longitudinally into a wetted chamber and a nonwetted chamber, d) a plurality of elongated Perkins tubes arranged in an annular array and mounted on the rotor for rotation therewith and each having opposite evaporation and condensing end sections, e) the Perkins tubes extending through the partition with the evaporation section registering with the nonwetted chamber and the condensing section registering with the wetted chamber, h) an air inlet in the case for introducing air into the nonwetted chamber for cooling the air, and i) an air outlet in the case for exhausting the cooled air from the nonwetted chamber to a space to be conditioned.

22. The rotary evaporative cooler of claim 21 including valve means operatively associated with the air inlet for selectively introducing into the nonwetted chamber air from the atmosphere and from a space to be conditioned.

23. A rotary evaporative cooler, comprising:

a) a hollow elongated case, b) an elongated rotor in the case mounted for axial rotation therein, c) a partition mounted for rotation with the rotor and separating the case longitudinally into a wetted chamber and a nonwetted chamber, d) a plurality of elongated Perkins tubes arranged in an annular array and mounted on the rotor for rotation therewith and each having opposite evaporation and condensing end sections, e) the Perkins tubes extending through the partition with the evaporation section registering with the nonwetted chamber and the condensing section registering with the wetted chamber, f) a first air inlet in the case for introducing air into the wetted chamber for humidifying the air, g) a first air outlet in the case for exhausting the humidified air from the wetted chamber, h) a second air inlet in the case for introducing air into the nonwetted chamber for cooling the air, i) a second air outlet in the case for exhausting the cooled air from the nonwetted chamber to a space to be conditioned, j) valve means for combining the air outputs from the first and second outlets for delivery to a space to be conditioned, k) valve means in the second air inlet for selectively introducing into the nonwetted chamber air from the atmosphere and from a space to be conditioned, l) valve control means operatively associated with the valve means in the first air outlet and second air inlet for adjusting the humidity of the air delivered to the space to be conditioned, m) a layer of porous metal bonded to the internal surfaces of the evaporation sections of the Perkins tubes in the nonwetted chamber of the case, n) a plurality of outwardly projecting heat conductive fins spaced apart along the length of an thermal contact with the outer surfaces of the Perkins tubes, o) water spray means in the wetted chamber of the case for supplying cooling water to the exterior surfaces of the fins on the Perkins tubes.

24. The rotary evaporative cooler of claim 23 wherein:

a) each Perkins tube is evacuated of noncondensible gases and is charged with a small quantity of liquid, b) the amount of liquid in each Perkins tube being capable of covering a maximum of about 25% of the internal condensing area of the tube, c) the layer of porous metal having a thickness of between 20 and 80 mils and a permeability of between 0.05 and 0.2 darcy, and d) the rotational speed of the rotor producing a centrifugal force field of about 100–200 gravities.

25. A rotary evaporative cooler, comprising:

a) an elongated, hollow case, b) an annular array of a plurality of elongated Perkins tubes mounted in the case for axial rotation therein, each Perkins tube having opposite evaporation and condensing end sections, c) a partition in the case mounted for rotation with the annular array and separating the case longitudinally into a wetted chamber and a nonwetted chamber, the Perkins tubes extending through the partition with the evaporation end sections registering with the nonwetted section and the condensing sections registering with the wetted section, d) a first air inlet in the case for introducing air into the wetted chamber and a first air outlet in the case for exhausting air from the wetted chamber to a space to be conditioned, e) a second air inlet in the case for introducing air into the nonwetted chamber and a second air outlet in the case for exhausting air from the nonwetted chamber, f) the second air outlet being coupled to the first air inlet for combining exhaust air in the second air outlet with air in the first air inlet for introduction to the wetted chamber.

26. The rotary evaporative cooler of claim 25 including valve means in the first air inlet upstream from the second air outlet coupling for varying the amount of inlet air for mixing with the air from the second air outlet.

* * * * *